US007943032B2

(12) United States Patent
Wurm et al.

(10) Patent No.: US 7,943,032 B2
(45) Date of Patent: May 17, 2011

(54) ANODE USED FOR ELECTROPLATING

(75) Inventors: Jorg Wurm, Kronberg (DE); Stephane Menard, Lyons (FR)

(73) Assignees: Metakem Gesellschaft fur Schichtchemie der Metalle mbH (DE); M.P.C. Micropulse Plating Concepts (FR)

( * ) Notice: Subject to any disclaimer, the term of this patent is extended or adjusted under 35 U.S.C. 154(b) by 1319 days.

(21) Appl. No.: 10/540,232

(22) PCT Filed: Dec. 23, 2003

(86) PCT No.: PCT/EP03/14785

§ 371 (c)(1),
(2), (4) Date: Jan. 23, 2006

(87) PCT Pub. No.: WO2004/059045

PCT Pub. Date: Jul. 15, 2004

(65) Prior Publication Data

US 2006/0124454 A1 Jun. 15, 2006

(30) Foreign Application Priority Data

Dec. 23, 2002 (DE) ..... 102 61 493

(51) Int. Cl.
*C25D 17/12* (2006.01)
*C25D 5/00* (2006.01)

(52) U.S. Cl. ..... 205/97; 204/280; 204/286.1

(58) Field of Classification Search ..... 205/97; 204/286.1

See application file for complete search history.

(56) References Cited

U.S. PATENT DOCUMENTS

| | | | | | |
|---|---|---|---|---|---|
| 3,875,041 | A * | 4/1975 | Harvey et al. | 204/273 |
| 4,075,069 | A * | 2/1978 | Shinohara et al. | 205/560 |
| 4,584,082 | A * | 4/1986 | Smith | 204/278 |
| 5,089,109 | A * | 2/1992 | Suganuma et al. | 204/290.03 |
| 5,102,521 | A * | 4/1992 | Usuda et al. | 204/198 |
| 5,560,815 | A | 10/1996 | Sekimoto et al. | |
| 5,626,730 | A | 5/1997 | Shimamune et al. | |
| 6,099,711 | A | 8/2000 | Dahms et al. | |
| 6,120,658 | A * | 9/2000 | Dunn et al. | 204/279 |
| 6,156,169 | A * | 12/2000 | Yang et al. | 204/280 |
| 6,391,170 | B1 * | 5/2002 | Day et al. | 204/279 |
| 6,402,909 | B1 * | 6/2002 | Tran et al. | 204/224 R |
| 6,425,991 | B1 * | 7/2002 | Tran et al. | 204/224 R |
| 6,602,394 | B1 * | 8/2003 | Hillebrand | 205/246 |
| 6,755,960 | B1 * | 6/2004 | Frischauf et al. | 205/246 |
| 6,852,209 | B2 * | 2/2005 | Kovarsky | 205/148 |
| 2002/0008036 | A1 * | 1/2002 | Wang | 205/118 |
| 2002/0046942 | A1 * | 4/2002 | Hanson et al. | 204/224 R |

FOREIGN PATENT DOCUMENTS

| | | |
|---|---|---|
| EP | 0 471 577 A1 | 8/1991 |
| EP | 0 990 423 A1 | 9/1999 |
| WO | WO 01/96631 | 12/2001 |

OTHER PUBLICATIONS

"Zinc Electrowinning under Periodical Reverse Current (PRC)" by Piron et al., J. Electrochem. Soc. 137(7) pp. 2126-2131 (1990).*

* cited by examiner

*Primary Examiner* — Harry D Wilkins, III
*Assistant Examiner* — Bryan D. Ripa
(74) *Attorney, Agent, or Firm* — Swanson & Bratschun, L.L.C.

(57) ABSTRACT

The present invention relates to an anode for electroplating, which has an anode base and a shield and is characterized in that additive degradation is reduced when it is used in electroplating.

14 Claims, 2 Drawing Sheets

Figure 1:
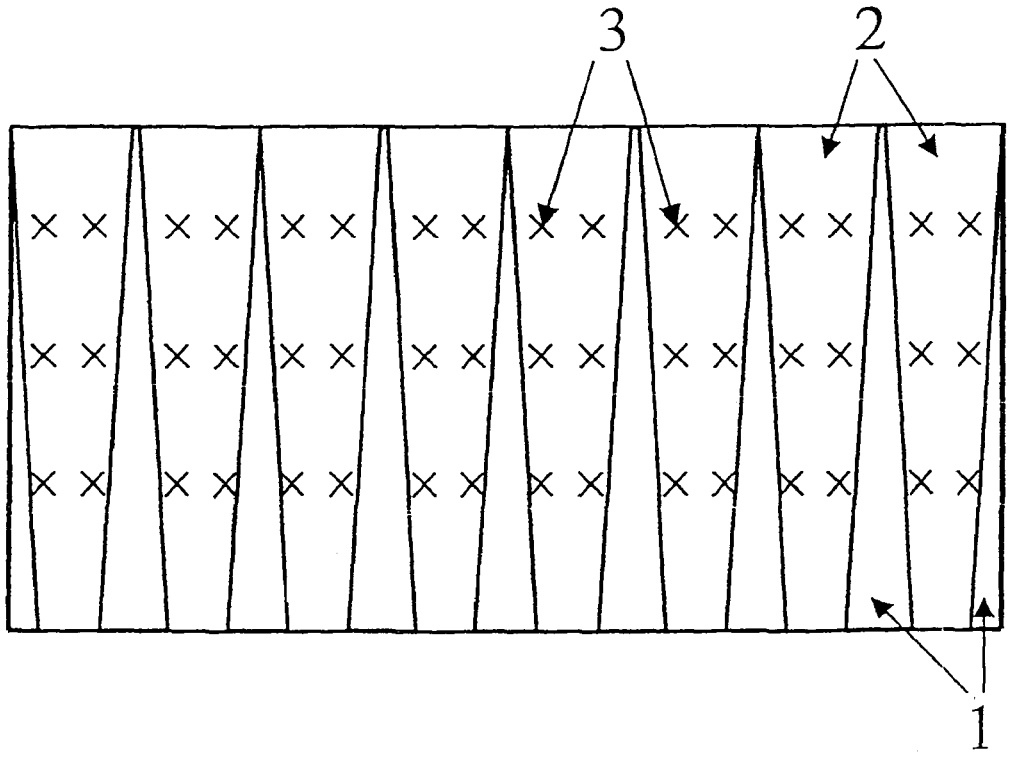
Figure 1:
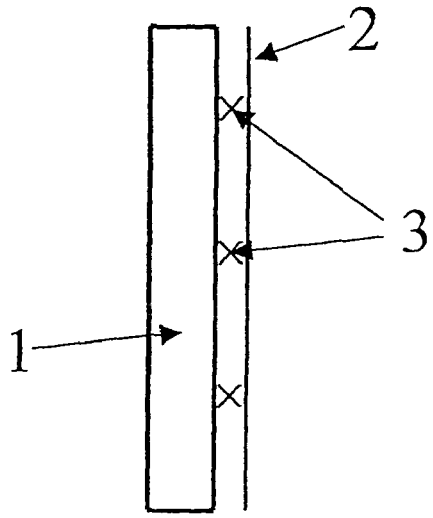

Plan view:

Side view:

ANODE USED FOR ELECTROPLATING

The invention relates to an anode for electroplating.

Many galvanic processes such as copper-plating, nickel-plating, zinc-coating, tin-plating etc. have hitherto been carried out mainly with soluble anodes. These are frequently plate anodes made from the respective metal or pieces of metal in titanium baskets.

In noble-metal baths, such as gold and platinum metal baths, on the other hand, it is customary to work with insoluble anodes.

Due to increasing automation in electroplating for industrial-scale coating, there is also however a tendency to switch to the use of insoluble anodes in the fields in which the use of soluble anodes was previously customary. Applications in these fields include e.g. the copper-plating of printed circuit boards, gravure-printing cylinders etc., the nickel-plating of engine cylinders etc.

A range of such insoluble anodes is known from the state of the art. These generally consist of a support material and an active layer. Customarily titanium, niobium etc. are used as carrier material. In every case, however, materials are used which are self-passivating under electrolysis conditions, thus e.g. the use of nickel in alkaline baths is also possible. The active layer is customarily an electron-conducting layer. It mostly consists of materials such as platinum, iridium, mixed oxides with platinum metals or diamond. The active layer can be located directly on the surface of the support material, but also on a substrate which is attached to the support material at a distance from it. For example materials which also come into consideration as support material can serve as substrate.

In most of the mentioned electroplating processes additives, which act as brighteners, increase hardness and broaden the spread, are added to the baths. These are in most cases organic compounds.

In most cases it is oxygen that forms at the insoluble anodes during electroplating, and chlorine in the case of chloride-containing baths. These gases, which are formed at the anode and in the case of vertical anodes climb these, can oxidize the additives and partly or even completely degrade them. This has two negative effects: firstly, the additives, some of which are very expensive, must continually be replaced, calling into question on economic grounds the use of the technically very advantageous insoluble anodes, and secondly the degradation products of the additive are disruptive, a consequence of which is that the baths must be replaced more frequently, which is also uneconomic and what is more also harmful to the environment.

A further problem arises in the case of noble-metal baths in which it has always been customary to work with insoluble anodes. Anodes whose base consists of titanium and whose active layer consists of platinum or mixed oxides are frequently used here. In operation this active layer is degraded very quickly (relative to the discharge in $Ah/m^2$) compared with active layers in base-metal electroplating. This is predominantly ascribed to the attack on this active layer by additives which dissolve the platinum metals of the layer by complexing. Additionally, cyanate and carbonate formation can also be disruptive in certain types of baths.

To solve this problem attempts have been made hitherto to keep organic compounds away from the anode. This occurred through the use of a membrane which in the case of a cation or anion exchange membrane, keeps charged additives away completely or, in the case of a diffusion membrane, greatly reduces the flow of additives to the anode. However, this solution requires a closed case with an anolyte around the anode, a separation of the electrolyte, and a higher voltage.

Thus, it can be used only at the cost of further disadvantages. Also, this process cannot be used at all in cases in which e.g. form anodes are used, such as e.g. for the internal coating of tubes.

Therefore it is the object of the invention to provide anodes which lead to a clearly reduced additive degradation and at the same time avoid the disadvantages of the use of a membrane.

The anode according to the invention for electroplating is distinguished by having an anode base and a shield, the anode base having a support material and an active layer, wherein the shield is attached to the anode base at a distance from it and is reducing the transport of material to and from the anode base.

The anode according to the invention is preferably an anode in which the support material is self-passivating under electroly-sis conditions.

Naturally, in the described anode according to the invention the active layer is preferably electron-conducting.

In a preferred embodiments of the anode according to the invention the shield can be made of plastic.

In another preferred embodiment of the anode according to the invention the shield is made of metal. This metal should be largely corrosion-resistant under anode conditions. Furthermore it is particularly preferred if the shield consists of a metal grid, an expanded metal or a perforated plate.

Additionally it is particularly advantageous if the shield is made of plastic and metal, since in this way different desirable material properties can be combined with one another. The metal shield can bring about an additional potential effect, while a transport can more easily be impacted with plastic. Therefore, a combination of two metal grids and a fine fabric or a plastic membrane located between them forms a preferred embodiment of the present invention. A particular advantage of this arrangement is its very easy assembly.

Furthermore it is particularly advantageous if the shield of the anode according to the invention is connected to the anode base in an electrically conductive manner. Because the shield is also connected to anodic potential, positively charged additives must overcome an electrostatic barrier, in addition to the mechanical barrier. The efficiency of the shield can thereby be clearly increased. Such a charged metallic shield acts electrostatically but, due to the oxide layer developing on the surface of the shield, cannot act electrochemically.

According to the invention, the shield is in particular at a distance of 0.01 to 100 mm from the anode base, preferably 0.05 to 50 mm, particularly preferably 0.1 to 20 mm and quite particularly preferably 0.5 to 10 mm. If the shield is not parallel to the anode base, such as in the case of a corrugated plate used as a shield, the above-given values relate to the average distance between the shield and the anode base. The effect of a shield located at this distance from the anode base is particularly great, since the additive molecules or ions must first cover a specific path section. This is a particular advantage e.g. compared with a shield which is applied directly to the surface of the anode body and is only a few micrometers thick. There is no reduction in the surface area of the active layer of the anode base in the anode according to the invention, which represents a further advantage compared with the mentioned anode with a shield directly located on the active layer.

In the case of the expanded-metal anodes, frequently used in place of plate anodes in electroplating, which always have an active layer at front and back, a shield for the anode base is also possible, but this is preferably likewise attached at the front and back.

Another preferred embodiment of the present invention is an anode in which the form of the shield, the arrangement and the distance from the anode base are such that the gas bubbles forming at the anode during operation are brought together.

In the case of the essentially perpendicularly located, smooth anodes, the gases forming at the anode rise in the form of small bubbles. The number of bubbles increases towards the top and therefore leads to an inhomogeneous shielding of the anode. Advantageously the anode according to the invention leads to a reduction of the number of bubbles, since the bubbles are concentrated and thus are larger. Since the additive degradation is partly a gas-fluid reaction, this change in the ratio of surface area to volume brings about a further reduction of the additive degradation. Because of the reduction in the shielding caused by the bubbles, there is advantageously also an increase in deposition rate. Another advantage is that the layer of the metal deposited on the cathode side becomes more homogeneous, since the inhomogeneity of the shielding caused by the bubbles is reduced. If there is a preset minimum layer thickness, the anode according to the invention thus also helps to save material. In order to obtain cathodically an essentially homogeneous layer, the gradient caused by the remaining bubbles over the whole of the anode and thus also the cathode can advantageously be compensated e.g. if the active layer of the anode base tapers downwards, or also compensated by using expanded metals with different surface factors.

Other reactions are advantageously also reduced or completely suppressed by the changed ratio of surface to volume. Thus the formation of e.g. Sn(IV) in Sn(II) baths or the formation of Cr(VI) in Cr(III) baths can be reduced, bringing with it substantial advantages in operation, since e.g. Sn(IV) precipitates as $SnO_2$ and results in many problems, such as masking of the anodes and blockage of circulation pumps. It is also worth attempting to avoid Cr(VI), since Cr(III) baths no longer work satisfactorily even at low Cr(VI) concentrations.

The occurrence of a smaller number of bubbles which have a correspondingly larger volume instead also means that the entrainment of constituents of the active layer of the anode is reduced when the forming bubbles are detached from it and thus the operating time of the anode is increased.

Furthermore it can be particularly advantageous that, if oxygen develops in the immediate surroundings of the anode $H^+$-ions remain which lower the pH value of the anode. For anodes which cannot be used at pH values greater than 12, the anode according to the invention advantageously also makes possible a use in strongly alkaline solutions, since the anode is essentially corrosion-resistant in operation because of the above-described local pH value reduction of the anode surroundings in the medium which thus forms. After polarization has finished such anodes are naturally to be removed from the bath.

According to the invention, the above-described anode can also be connected as a cathode. If the anode is cathodically connected the shield is not self-passivating. Therefore a large surface area is advantageous, since this reduces the current density and thus the cathodic overvoltage. This leads to a longer operating time of the anode connected as a cathode.

Furthermore the invention relates to electroplating processes in which an anode as described above is used. In addition to the customary anodic use of the anode according to the invention, a cathodic connection of the anode, i.e. the anode represents the cathode, is also of importance,—this is the case with inter alia so-called reverse-pulse processes. In this reverse-pulse process the polarity reversal can take place at various points of the electroplating process. E.g. when copper-coating the holes of printed circuit boards a series of pulses is first sent to the printed circuit board to be coated, which has a cathodic potential, and the anode according to the invention, which has an anodic potential. The polarization is reversed for a few milliseconds at the end, the printed circuit board then having an anodic potential, while the anode according to the invention functions as a cathode. Otherwise, e.g. when hard-chrome-plating an object made of iron, frequently the iron object is first set to anodic potential in order to activate the surface. In this process step, called "etching", the anode according to the invention is the cathode. After a period in the minutes range, the polarization is then reversed and the anode according to the invention, now having an anodic potential, is used in the customary manner to electroplate the iron object which now has a cathodic potential. In both cases the shield of the anode brings about a drop in the current density during the polarity reversal, which is advantageous for the life of the anode.

The use of an anode as described above for electroplating is a further subject of the invention.

Additionally an anode for electroplating which has a support material and an active layer is a subject of the invention, wherein the active layer has two ends and the surface area of the active layer decreases from the one end which is essentially on top in operation to the other end which is essentially underneath in operation.

In a preferred embodiment this is an anode, wherein the active layer is attached directly to the support material.

In another preferred embodiment this is an anode, wherein the active layer is attached to the support material at a distance from it. In this case the active layer is particularly preferably applied to a substrate and this substrate attached to the support material. The substrate can then be located directly on the support material or at a distance from the support material. An anode is quite particularly preferred in which the substrate carrying the active layer is attached to the support material by spot welds.

To describe this subject of the invention in more detail, a particularly preferred embodiment is represented by way of example in FIG. 1. FIG. 1 shows both the plan view (top) and a side view (bottom) of a particularly preferred embodiment of the invention. The anode shown has a support material (1) and attached thereupon an active layer (2), applied to a substrate, which is attached at a distance from the support material (1). Titanium for example can serve as support material, likewise titanium for example can also be used as substrate and the active layer can consist of e.g. metal oxide (MOX). The active layer is thus attached to the support material because the active layer-bearing substrate is attached to the support material. This attachment can be achieved e.g. by screwing, riveting and preferably spot-welding. In FIG. 1 the crosses (3) therefore represent e.g. spot welds.

A particular advantage of the anode according to the invention is that the shielding caused by the bubbles forming at the anode in operation and the resulting inhomogeneity of the deposition at the cathode can be essentially compensated for, so that layers which have a more uniform thickness can be deposited at the cathode. A person skilled in the art will be able to determine, by carrying out simple preliminary tests, which geometrical arrangement is to be chosen in the individual case.

This anode can, according to the invention, likewise be connected as a cathode.

Furthermore the invention relates to electroplating processes in which an anode as described above is used.

The use of an anode used as described above for electroplating is a further subject of the invention.

The invention is described in more detail below by means of examples.

EXAMPLES

Example 1

Figure 2:
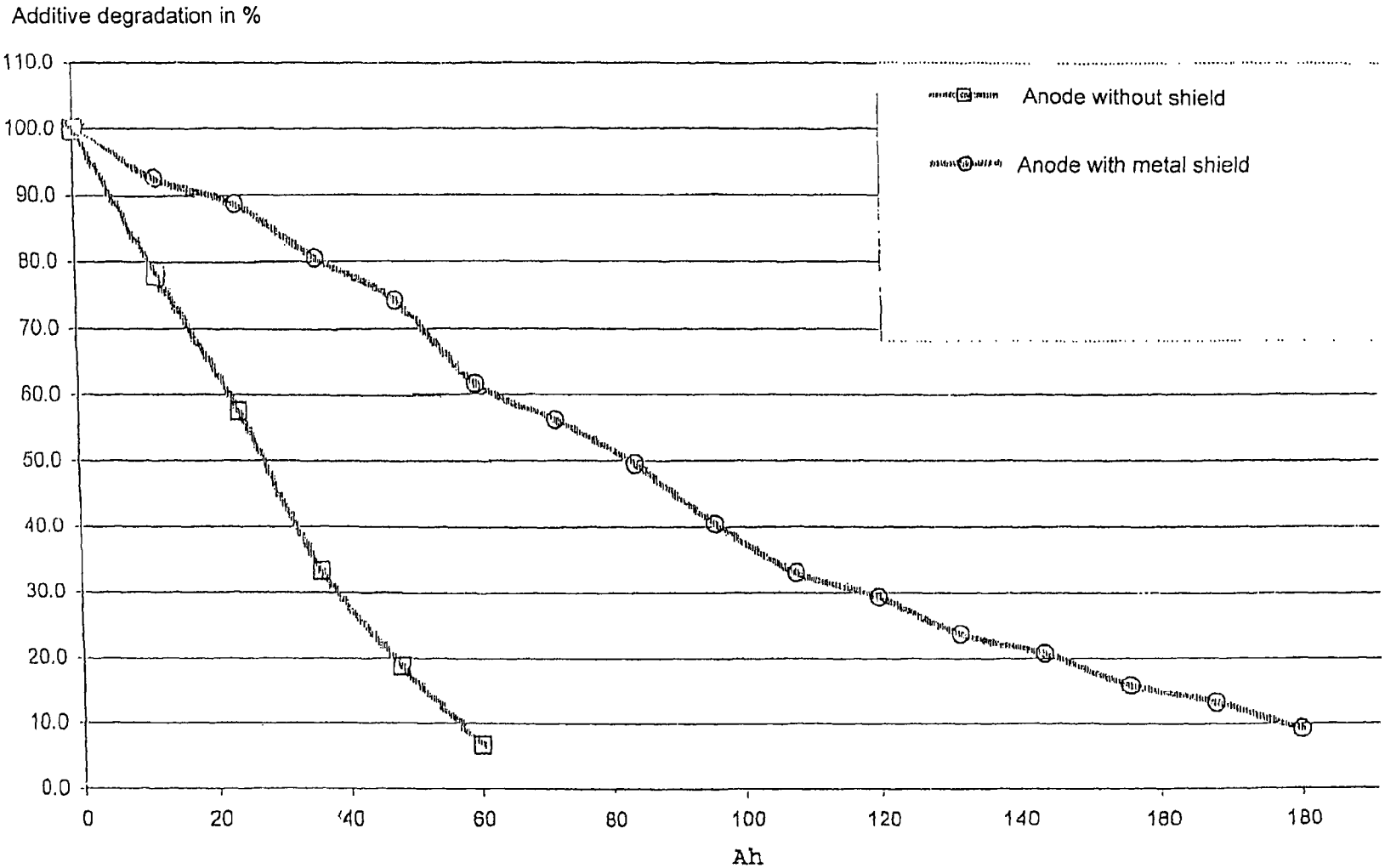

Additive degradation was investigated under the working conditions of a sulfuric acid copperplating bath in d.c. operation. A sulfur compound served as additive. Two d.c. plates with an active layer of mixed oxide were used as anodes. The first consisted only of the anode base and the second anode, according to the invention, of anode base and shield. A brass plate was used in each case as cathode. Additive consumption when using the two anodes was measured cyclovoltametrically and is plotted in FIG. 2 against the flowed ampere-hours. It is clear that additive degradation when using the second anode according to the invention is reduced by a factor of 2.5 to 3 compared with additive degradation when using the first anode.

Example 2

Bubble formation was investigated under production conditions in a sulfuric acid copperplating bath for the copperplating of holes under reverse-pulse plating conditions. Two anodes were suspended side by side on the side wall of a vertical coating unit. The first anode consisted only of an anode base which was composed of a support material of titanium and an active layer of mixed oxide and was 1100 mm×500 mm×1.5 mm in size. The second anode, according to the invention, likewise consisted of a base which consisted of titanium as support material and a mixed oxide as active layer and was the same size as the base of the first anode, and a shield made of titanium expanded metal. In operation, the same current was passed through both anodes and in the case of the first anode the customary bubble formation and a consequently strongly-moved bath observed. In the case of the second anode, according to the invention, on the other hand, the bubble formation was greatly reduced.

Example 3

To investigate the Sn(IV) concentration in Sn(II) baths, the concentrations of the two species were measured under customary deposition conditions in d.c. operation in a bath with tin-methanesulfonic acid. Two d.c. plates with an active layer of mixed oxide were used as anodes. The first anode consisted only of the anode base, the second, according to the invention, of anode base and shield. A brass plate served as cathode during the experimental depositions.

Before deposition, the following concentrations were measured in the bath of the first anode consisting only of anode base:

Sn(II): 40.8 g/l, Sn(IV): 7.7 g/l, giving an overall Sn concentration of 48.5 g/l.

After deposition the following values were measured in the bath of the first anode:

Sn(II): 33.1 g/l, Sn(IV): 9.4 g/l, giving an overall Sn concentration of 42.5 g/l.

Before deposition the following concentrations were measured in the bath of the second anode, according to the invention, which consisted of anode base and shield:

Sn(II): 39.0 g/l, Sn(IV): 10.5 g/l, giving an overall Sn concentration of 49.5 g/l.

After deposition the following values were measured in the bath of the first anode:

Sn(II): 34.3 g/l, Sn(IV): 8.5 g/l, giving an overall Sn concentration of 42.8 g/l.

These results clearly show that Sn(IV) concentration increases during operation in the bath of the anode consisting only of anode base. In contrast to this the Sn(IV) concentration actually falls when the anode according to the invention is used.

The invention claimed is:

1. An anode for electroplating, which comprises an anode base and a shield, wherein the anode base comprises a support material and an active layer, and wherein the shield is attached to the anode base at a distance from it and reduces material transport to and from the anode base, wherein the shield comprises a conductive metal material or a conductive metal and plastic material and wherein the conductive metal material of the shield is connected to the anode base in an electric current-conducting manner providing an electrostatic barrier.

2. The anode according to claim 1, in which the support material is self-passivating under electrolysis conditions.

3. The anode according to claim 1, in which the active layer is electron-conducting.

4. The anode according to claim 1, in which the shield comprises at least one of a metal grid, an expanded metal and a perforated plate.

5. The anode according to claim 1, in which the shield is at a distance of 0.01 to 100 mm from the anode base.

6. The anode according to claim 1, in which the form of the shield and the arrangement and the distance of the shield from the anode base are such that the gas bubbles forming at the anode during electroplating are brought together.

7. The anode according to claim 1, in which the anode is connected as a cathode.

8. A method of electroplating comprising: providing an anode base comprising a support material and an active layer;

providing a shield attached to the anode base at a distance from the anode base; wherein the shield comprises a conductive metal material or a conductive metal and plastic material and wherein the shield is connected to the anode base in an electric current-conducting manner;

applying electrical current to the anode base and shield;

reducing material transport to and from the anode base through the action of the shield as a mechanical barrier; and reducing material transport to and from the anode base through the action of the shield as an electrostatic barrier.

9. The method of electroplating of claim 8 further comprising providing a support material that is self-passivating under electrolysis conditions.

10. The method of electroplating of claim 8 further comprising providing an active layer that is electron conducting.

11. The method of electroplating of claim 8 further comprising providing a shield comprising at least one of a metal grid, an expanded metal and a perforated plate.

12. The method of electroplating of claim 8 further comprising attaching the shield to the anode base at a distance of 0.01 to 100 mm.

13. The method of electroplating of claim 8 further comprising forming the shield and selecting the distance of the shield from the anode base such that gas bubbles forming at an anode during electroplating are brought together.

14. The method of electroplating of claim 8 further comprising applying cathodic current to the anode base.

* * * * *